US008389187B2

(12) United States Patent
Kadokura et al.

(10) Patent No.: US 8,389,187 B2
(45) Date of Patent: Mar. 5, 2013

(54) TRANSPARENT TONER FOR ELECTROSTATIC LATENT IMAGE DEVELOPING, ELECTROSTATIC LATENT IMAGE DEVELOPER, TONER CARTRIDGE, PROCESS CARTRIDGE, IMAGE FORMING APPARATUS AND IMAGE FORMING METHOD

(75) Inventors: Yasuo Kadokura, Kanagawa (JP); Atsushi Sugawara, Kanagawa (JP); Masaru Takahashi, Kanagawa (JP); Yusuke Ikeda, Kanagawa (JP); Masanobu Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 701 days.

(21) Appl. No.: 12/567,094

(22) Filed: Sep. 25, 2009

(65) Prior Publication Data

US 2010/0216066 A1 Aug. 26, 2010

(30) Foreign Application Priority Data

Feb. 20, 2009 (JP) ..... 2009-037898

(51) Int. Cl.
*G03G 9/08* (2006.01)

(52) U.S. Cl. ..... 430/108.8; 430/108.1; 430/109.1; 430/109.4

(58) Field of Classification Search ..... 430/108.1, 430/108.8, 109.1, 109.4
See application file for complete search history.

(56) References Cited

U.S. PATENT DOCUMENTS

2005/0214669 A1 * 9/2005 Hayashi et al. ..... 430/109.4

FOREIGN PATENT DOCUMENTS

JP A-10-073952 3/1998

* cited by examiner

*Primary Examiner* — Hoa V Le
(74) *Attorney, Agent, or Firm* — Oliff & Berridge, PLC

(57) ABSTRACT

A transparent toner for electrostatic latent image developing, including a binder resin and a release agent, the difference between Tm and Tc being from about 30° C. to about 50° C., wherein Tm is an endothermic peak temperature of the release agent determined in a temperature rising process and Tc is an exothermic peak temperature of the release agent determined in a temperature decreasing process, in a measurement by a differential scanning calorimeter (DSC) according an ASTM method, and the toner having a weight average molecular weight of from about 35,000 to about 70,000.

17 Claims, 2 Drawing Sheets

TRANSPARENT TONER FOR ELECTROSTATIC LATENT IMAGE DEVELOPING, ELECTROSTATIC LATENT IMAGE DEVELOPER, TONER CARTRIDGE, PROCESS CARTRIDGE, IMAGE FORMING APPARATUS AND IMAGE FORMING METHOD

CROSS-REFERENCE TO RELATED APPLICATION

This application claims priority under 35 USC 119 from Japanese Patent Application No. 2009-037898, filed on Feb. 20, 2009.

BACKGROUND

1. Technical Field

The present invention relates to a transparent toner for developing an electrostatic latent image, an electrostatic latent image developer, a toner cartridge, a process cartridge, an image forming apparatus, and an image forming method.

2. Related Art

Methods of visualizing image information via an electrostatic latent image such as by electrophotography are currently utilized in a variety of fields. In electrophotography, an image is formed and visualized via steps of forming an electrostatic charge image on a latent image holding member (photoreceptor) by charging and exposure, developing the electrostatic latent image with a developer containing a toner to form a toner image, transferring the toner image onto a recording medium, and fixing this toner image onto the recording medium.

According to color image formation by color electrophotography that has come into widespread use in recent years, color reproduction is generally performed using toners of four colors including toners of the three colors of yellow, magenta, and cyan, i.e., the subtractive three primary colors, and a black toner.

According to a general color electrophotography method, a document (image information) is first color-separated into yellow, magenta, cyan, and black, and an electrostatic latent image of each color is formed on the surface of a photoreceptor. In this case, the formed electrostatic latent images of the respective colors are developed using developers respectively containing a toner of one of the respective colors to form toner images, and the toner images are transferred to the surface of a recording medium through a transfer process. A series of processes from the formation of the electrostatic latent image to the transfer of the toner image to the surface of the recording medium are successively performed for each color. The toner images of the respective colors are disposed on the surface of the recording medium in such a manner as to correspond to the image information, and then transferred. A color toner image obtained when the toner images of the respective colors are transferred to the surface of the recording medium as described above is fixed as a color image through a fixing process.

In the color image formation, attempts have been made to correct gloss differences in an image surface, control gloss on a transfer paper, or correct image density and the toner adhesion amount using a transparent toner in addition to Y (yellow), M (magenta) C (cyan), and BK (black) toners.

SUMMARY

According to an aspect of the invention there is provided a transparent toner for electrostatic latent image developing, including a binder resin and a release agent, the difference between Tm and Tc being from about 30° C. to about 50° C., wherein Tm is an endothermic peak temperature of the release agent determined in a temperature rising process and Tc is an exothermic peak temperature of the release agent determined in a temperature decreasing process, in a measurement by a differential scanning calorimeter (DSC) according an ASTM method, and the toner having a weight average molecular weight of from about 35,000 to about 70,000.

BRIEF DESCRIPTION OF THE DRAWINGS

Exemplary embodiments of the present invention will be described in detail based on the following figures, wherein.

DETAILED DESCRIPTION

Figure 1:
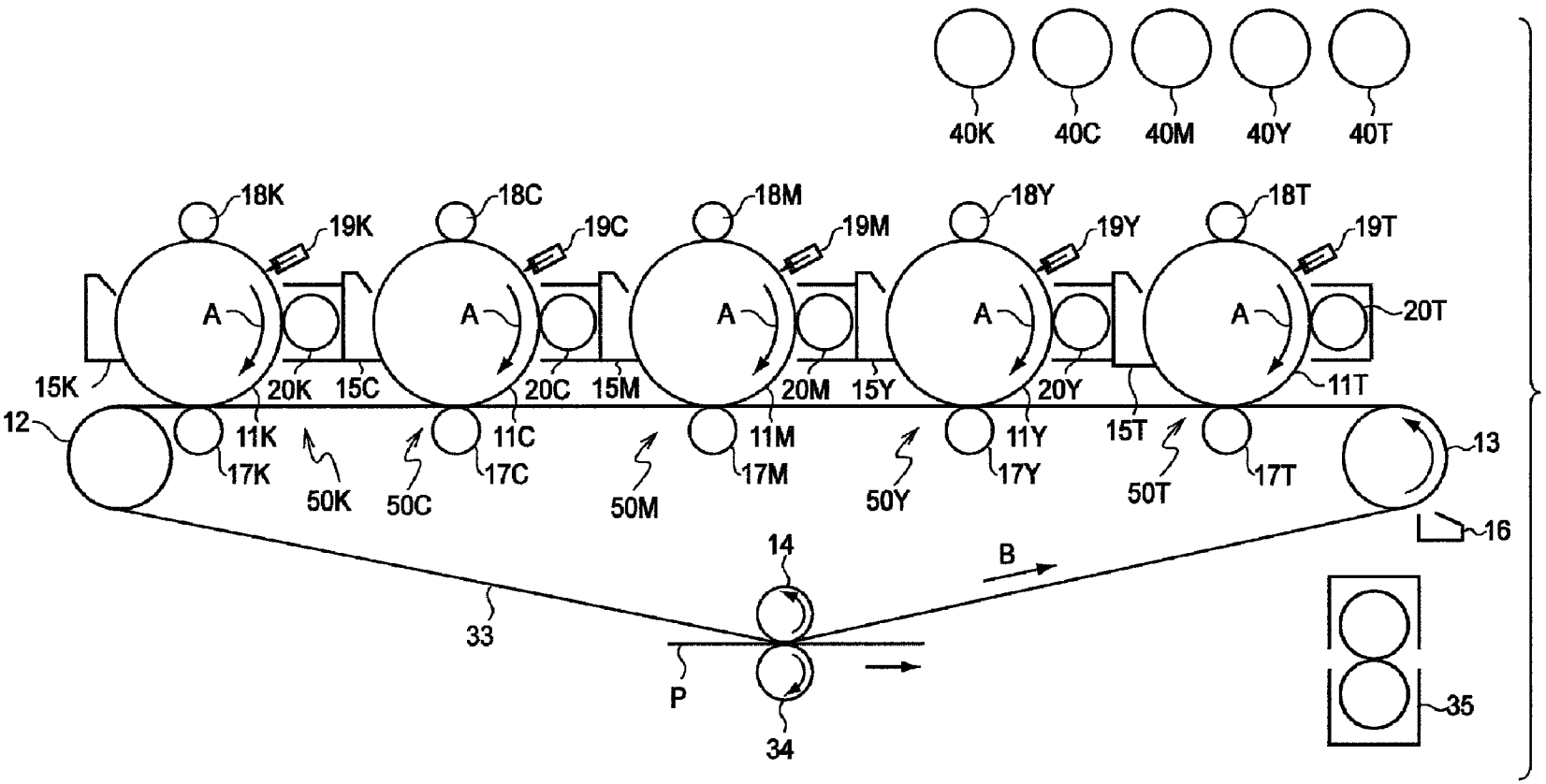
FIG. 1 is a schematic configuration diagram illustrating an example of an image forming apparatus according to an exemplary embodiment of the present invention.

Hereinbelow, a transparent toner for electrostatic latent image developing, an electrostatic latent image developer, a toner cartridge, a process cartridge, an image fowling apparatus, and an image forming method of exemplary embodiments of the present invention will be described.

<Transparent Toner for Electrostatic Latent Image Developing>

The transparent toner for electrostatic latent image developing according to the exemplary embodiment includes a binder resin and a release agent, the difference between Tm and Tc is from 30° C. (or about 30° C.) to 50° C. (or about 50° C.), wherein Tm is an endothermic peak temperature of the release agent determined in a temperature rising process and Tc is an exothermic peak temperature of the release agent determined in a temperature decreasing process, in a measurement by a differential scanning calorimeter (DSC) according an ASTM method, and the toner has a weight average molecular weight of from 35,000 (or about 35,000) to 70,000 (or about 70,000).

In the exemplary embodiment, the transparent toner refers to a toner used for a transparent toner image. Specifically, the transparent toner may be an almost colorless toner in which the content of colorants, such as a dye or a pigment, is 0.01% by weight (or about 0.01% by weight) or lower.

When the difference between Tm and Tc is lower than 30° C., the crystallinity of a release agent is high (which means that the release agent is easily crystallized when cooled). When the difference between Tm and Tc is 30° C. or more, the crystallinity when cooling is poor (which means that the release agent is hard to crystallize even when cooled) and a certain crystallization inhibition factor may be present.

In conventional color toners, such as a cyan toner, a magenta toner, a yellow toner, or a black toner, the release agent does not mutually dissolve with a binding resin or a colorant in the toner irrespective of production processes, such as a kneading pulverization method, an emulsion aggregation method (an EA method), and a suspension polymerization method. Therefore, the crystallinity of the release agent is hard to deteriorate. When a toner is measured by DSC, the Tm (endothermic peak) and the Tc (exothermic peak) steming from the release agent are almost the same value. When the Tm and the Tc are close to each other, crystal growth is likely to occur at the time of cooling the release agent which as been melted by heating. By the crystal growth of the release agent, the crystal form of the release agent becomes a flat shape.

When the crystal growth of the release agent occurs, the crystal form of the release agent becomes a flat shape also in a transparent toner similarly as in the color toners. In particular, when a fixed image is gradually cooled, the release agent in the fixed image undergoes crystal growth to increase a release agent domain diameter, and moreover the release agent domains are likely to become a flat shape. In the color toners, gloss unevenness does not arise irrespective of the crystal form of the release agent because light is reflected on the surface of the fixed image. However, in the case of the transparent toner, light enters into a transparent fixed image and is reflected on the release agent in the transparent toner or the surface of a paper (transfer object) on which the transparent toner is fixed. When the crystal form of the release agent in the transparent toner is in a flat shape, diffused reflection of light occurs. Therefore, when the toner density is high, gloss unevenness may occur in some cases.

Even when a transparent toner is produced according to the invention in JP-A No. 10-73952 but removing a colorant, crystallization of the release agent in the fixed image cannot be suppressed simply by adjusting the branch carbon content to a given content as a measure for suppressing the crystal growth of the release agent, sometimes resulting in that the crystal form of the release agent becomes a flat shape. For example, the difference between Tm and Tc of a transparent toner using FNP90 (trade name, manufactured by Nippon Seiro Co., Ltd.) is 5° C. In this case, when the molten release agent melted by heating is gradually cooled, the crystal form of the release agent is likely to become a flat shape.

As a measure for suppressing gloss unevenness of the fixed transparent toner, there is a method for keeping the crystal form of the release agent in a fixed image spherical so as to suppress diffused reflection of light by the release agent. However, a usual release agent undergoes crystal growth. Heretofore, there have been no methods for suppressing the crystal growth thereof to prevent the crystal form from becoming a flat shape. As a measure for suppressing the crystal growth, addition of a crystallization inhibitor may be mentioned. However, the simple addition of a crystallization inhibitor results in that the inhibitor is present in a binding resin. Thus, effects of the inhibitor can be expected as the effects from the outside of the release agent domain. However, the crystal growth of the release agent occurs in all the directions, and it is substantially difficult to suppress the crystal growth only by the effects from the outside of the release agent. Thus, the addition of a crystallization inhibitor is insufficient as the measure for suppressing gloss unevenness.

In the exemplary embodiment, the difference between Tm and Tc is in the range of from 30° C. (or about 30° C.) to 50° C. (or about 50° C.), whereby the crystal growth of the release agent contained in the transparent toner may be suppressed, and the crystal form of the release agent may be controlled so that it does not become a flat shape. As a result of this, the development of gloss unevenness of the fixed transparent toner may be suppressed. The gloss unevenness is likely to occur particularly on a preceding surface during printing of a following surface in the case of double-side printing. However, when the toner according to the exemplary embodiment is used, the occurrence of gloss unevenness on the preceding surface during printing of the following surface may be effectively suppressed.

The preceding surface refers to a paper surface on which an image is first fixed when double-side printing is carried out. The following surface refers to a paper surface on which an image is fixed later when double-side printing is carried out.

When the image density of a toner image formed on an OHP using a color toner is low (e.g., 50% or lower), the surface smoothness of a fixed image may be poor, sometimes resulting in that light scattering occurs to reduce OHP transparency. Therefore, when the toner image is smoothened by adhering the transparent toner to the entire surface of an OHP for preventing light scattering, the OHP transparency may increase.

On the other hand, in order to improve scratch resistance of the fixed image against external force, such as scratch, it is required to increase strength of the fixed image. Examples of the method for increasing strength of the fixed image include a method for increasing the molecular weight of the toner. However, when the molecular weight of the toner becomes large, the amount of heat required for fixing the toner increases. When a dispersion degree of the release agent in the toner is poor (i.e., when the release agent domain is large), release agent domains are combined with each other by heat at the time of toner fixation to form a larger release agent domain. The enlargement of the release agent domains deteriorates OHP transparency.

The toner according to the exemplary embodiment has a difference between Tm and Tc of 30° C. or more. Therefore, the release agent may be finely dispersed in the toner, and thus the crystal growth of the release agent may be hard to occur. Therefore, even when a large amount of heat is applied when a toner having a large molecular weight is fixed, the crystal growth of the release agent may be suppressed, and thus deterioration of OHP transparency may be suppressed.

In the exemplary embodiment, the weight average molecular weight of the toner is from 35000 (or about 35000) to 70000 (or about 70000). When the weight average molecular weight of the toner is lower than 35000, the strength of the fixed image may become insufficient in some cases. When the weight average molecular weight of the toner exceeds 70000, the transmittance of the fixed image may deteriorate in some cases.

The weight average molecular weight of the toner is preferably from 35000 to 65000 and more preferably from 36000 to 60000.

In the exemplary embodiment, the weight average molecular weight is determined by measuring a THF soluble material with a THF solvent using GPC•FILC-8120 manufactured by Tosoh Corp. and a column•TSKgel SuperHM-M (15 cm) manufactured by Tosoh Corp. and calculating based on a molecular weight calibration curve produced from a monodisperse polystyrene standard sample.

In the exemplary embodiment, the difference between Tm and Tc is from 30° C. (or about 30° C.) to 50° C. (or about 50° C.). When the difference between Tm and Tc is lower than 30° C., the release agent may not be sufficiently finely dispersed, sometimes resulting in that the crystal growth of the release agent is accelerated when the toner image is fixed. As a result, it may become difficult to suppress gloss unevenness in some cases. It is technically difficult to increase the difference between Tm and Tc to 50° C. or more.

The Tm and the Tc based on ASTM (D3418-8, the disclosure of which is incorporated by reference herein) by a differential scanning calorimeter (DSC) are obtained by the following method. 1) 10 mg of a sample is placed in an aluminum cell, and the aluminum cell is covered (which is referred to as a sample cell). For comparison, 10 mg of alumina is similarly placed in an aluminum cell of the same type, and the aluminum cell is covered (which is referred to as a comparative cell). 2) Each of the sample cell and the comparative cell is set in a measuring apparatus, the temperature of each cell is increased from 30° C. to 200° C. under a nitrogen atmosphere at a temperature increase rate of 10° C./minute, and then, the cells are allowed to stand at 200° C. for 10 minutes. 3) After allowed to stand, the temperature is reduced to −30° C. using liquid nitrogen at a temperature decrease rate of −10° C./minute, and the cells are allowed to stand at −30° C. for 10 minutes. 4) After allowed to stand, the temperature is increased from −30° C. to 200° C. at a temperature increase rate of 20° C./minute. The endothermic•exotherm curve is obtained in the process 4). The Tm and the Tc are determined from the obtained endothermic•exotherm curve. As a measuring apparatus, a differential scanning calorimeter DSC-7 manufactured by PerkinElmer, Inc. is used.

It is judged as follows whether or not the Tm and the Tc stem from the release agent contained in the toner in the obtained endothermic•exotherm curve.

First, the toner is melted in toluene heated to 180° C., and then cooled to separate only a crystallized release agent therefrom. The endothermic peak during temperature rise of the obtained release agent is determined by DSC similarly as above. In this case, when the Tm of the toner and the endothermic peak of only the release agent are in agreement with each other, the Tm of the toner can be judged to stem from the release agent contained in the toner.

Next, toluene of the toner dissolved toluene remaining when only the release agent is separated is volatilized. Then, the exothermic peak during temperature decrease of the remaining solid, is determined by DSC similarly as above. The exothermic peak at this time is judged to originate from a substance other than the release agent. Thus, the Tc of the toner other than these peaks can be judged to originate from the release agent.

In one example of the exemplary embodiment, metal elements, such as Al, can be blended in the release agent domains of the toner. The metal elements, such as Al, have a function as a crystallization inhibitor to the release agent. The metal elements, such as Al, are ionic-bonded to a binding resin of the toner to exhibit an effect of suppressing the crystal growth of the release agent. As the result, the difference between Tm and Tc is from 30° C. to 50° C. Thus, the occurrence of gloss unevenness after fixation may be more effectively suppressed.

As the metal element contained in the release agent domains, Al is preferable because Al has a high valency and may be effective for crystallization inhibition of the release agent by ionic bond.

A method for blending the metal elements, such as Al, in the release agent domains will be described later.

It is confirmed by the following method whether or not the metal elements, such as Al, are contained in the release agent domains.

First, the toner particles are embedded using a bisphenol A type liquid epoxy resin and a curing agent, and a cutting sample is prepared. Next, the cutting sample is cut at a temperature of −100° C. using a cutting machine in which a diamond knife is used, e.g., LEICA ULTRAMICROTOME (manufactured by Hitachi Technologies), thereby producing an observation sample. The observation sample is allowed to stand in a desiccator, which is in a ruthenium-tetraoxide atmosphere, for staining. Judgment of staining can be performed according to a staining state of a tape that is simultaneously allowed to stand. The observation sample thus stained can be observed at a magnification of about 5000 times by TEM.

Since a toner sample is colored by ruthenium tetraoxide, the binding resin or the release agent can be distinguished based on the staining concentration differences and the shape. A portion in the toner that is present in the form of a rod shape or a massive shape and has a whiter contrast is judged to be a release agent domain.

Next, with respect to the metal elements, such as Al, in the release agent domains, the observation sample is mapped at an acceleration voltage of 20 kV using an energy dispersive X-ray analyzer EMAX model 6923H (manufactured by HORIBA) attached to an electron microscope S4100, and it is judged whether or not the metal elements are contained in the release agent domains.

The Al content in the release agent domains of the toner by fluorescent X-ray analysis is preferably from 0.005 atom % (or about 0.005 atom %) to 0.10 atom % (or about 0.10 atom %), more preferably from 0.005 atom % to 0.05 atom %, and even more preferably from 0.01 atom % to 0.05 atom %.

When the Al content is lower than 0.005 atom %, the crystal growth of the release agent cannot be suppressed and the development of gloss unevenness cannot be suppressed in some cases. On the other hand, when the Al content is higher than 0.10 atom %, the crystal growth of the release agent may be suppressed. However, since melting of the release agent is suppressed, separability of a transfer object from a fixation member may be poor. Particularly when low-temperature fixation is performed or a process speed is 500 mm/s, the separability may particularly deteriorate. When the Al content in the release agent domains is in the above-mentioned range, the development of gloss unevenness after fixation may be more effectively suppressed.

In the exemplary embodiment, the low-temperature fixation refers to fixing a toner by heating at about 120° C. or lower.

Hereinafter, components used in the toner according to the exemplary embodiment will be described.

The toner according to the exemplary embodiment contains a binding resin and a release agent, and, as required, may further contain other additives.

(Binding Resin)

Examples of the binding resin in the exemplary embodiment include known resin materials, such as a styrene/acryl resin, an epoxy resin, a polyester resin, a polyurethane resin, a polyamide resin, a cellulose resin, a polyether resin, or a polyolefin resin. A polyester resin is particularly preferable.

When a polyester resin is used, sharp melting properties as a toner may be easily obtained, and thus is preferable. Since a polyester resin has a strong negative chargeability, adverse effects on the chargeability may be suppressed. A polyester resin is preferable also from the viewpoint of increasing the strength of the toner or the strength of the fixed image.

Hereinafter, the description will be given mainly to a polyester resin as a typical example of an amorphous resin in the exemplary embodiment.

Examples of a polyester resin preferably used in the exemplary embodiment include resins obtained by, for example, condensation polymerization of polyvalent carboxylic acid(s) and polyhydric alcohol(s).

Examples of polyvalent carboxylic acid include aromatic carboxylic acids, such as terephthalic acid, isophthalic acid, phthalic anhydride, trimellitic anhydride, pyromellitic acid, or naphthalene dicarboxylic acid; aliphatic carboxylic acids, such as maleic anhydride, fumaric acid, succinic acid, alkenyl succinic anhydride, or adipic acid; and alicyclic carboxylic acids, such as cyclohexanedicarboxylic acid. These polyvalent carboxylic acids can be used singly or in combination of two or more thereof. Among these polyvalent carboxylic acids, it is preferable to use aromatic carboxylic acid(s). In order to secure favorable fixability and obtain a cross-linked structure or a branched structure, it is preferable to use tri- or higher valent carboxylic acid(s) (e.g., trimellitic acid or acid anhydrides thereof) in combination with dicarboxylic acid(s).

Examples of polyhydric alcohol in the polyester resin include aliphatic dials, such as ethylene glycol, diethylene glycol, triethylene glycol, propylene glycol, butanediol, hexanediol, neopentyl glycol, or glycerol; alicyclic dials, such as cyclohexane diol, cyclohexane dimethanol, or hydrogenated bisphenol A; and aromatic diols, such as an ethylene oxide adduct of bisphenol A or a propylene oxide adduct of bisphenol A. These polyhydric alcohols can be used singly or in combination of two or more thereof. Among these polyhydric alcohols, aromatic dials and alicyclic diols are preferable, and aromatic diols are more preferable among the above. In order to secure favorable fixability and obtain a cross-linked structure or a branched structure, it is preferable to use tri- or higher valent polyhydric alcohol(s) (glycerol, trimethylolpropane, pentaerythritol) may be used in combination with dials.

The weight average molecular weight (Mw) of a polyester resin is preferably from 5000 to 50000 and more preferably from 7000 to 20000. When the molecular weight (Mw) is lower than 5000, the glass transition temperature of the toner decreases. Therefore, storability, such as blocking of the toner, may be adversely affected in some cases. When the weight average molecular weight (Mw) exceeds 50000, hot offset resistance can be sufficiently given but fixability may decrease and also exudation of the release agent present in the toner may e suppressed. Therefore, storability of the fixed image may be adversely affected.

The glass transition temperature (Tg) of the polyester resin is preferably in the range of from 50° C. (or about 50° C.) to 80° C. (or about 80° C.). When the Tg is lower than 50° C., problems may arise from the viewpoint of storability of the toner or storability of the fixed image in some cases. When the Tg is higher than 80° C., fixation cannot be effected at a temperature lower than that of a former case in some cases.

The Tg of a polyester resin is more preferably from 50° C. to 65° C.

The glass transition temperature of the polyester resin is determined as a peak temperature of the endothermic peak obtained by the above-described differential scanning calorimetry (DSC).

For the purpose of, for example, adjusting an acid value or a hydroxyl value, polyvalent carboxylic acid or polyhydric alcohol may be added as required in a final stage of synthesis. Examples of polyvalent carboxylic acid include aromatic carboxylic acids, such as terephthalic acid, isophthalic acid, phthalic anhydride, trimellitic anhydride, pyromellitic acid, or naphthalene dicarboxylic acid; aliphatic carboxylic acids, such as maleic anhydride, fumaric acid, succinic acid, alkenyl succinic anhydride, or adipic acid; alicyclic carboxylic acids, such as cyclohexanedicarboxylic acid; and aromatic carboxylic acids having at least three carboxy groups in a single molecule, such as 1,2,4-benzenetricarboxylic acid, 1,2,5-benzene tricarboxylic acid, or 1,2,4-naphthalenetricarboxylic acid.

Example of polyhydric alcohol include aliphatic diols, such as ethylene glycol, diethylene glycol, triethylene glycol, propylene glycol, butanediol, hexanediol, neopentyl glycol, or glycerol; alicyclic diols, such as cyclohexanediol, cyclohexane dimethanol, or hydrogenated bisphenol A; and aromatic diols, such as an ethylene oxide adduct of bisphenol A or a propylene oxide adduct of bisphenol A.

The polyester resin can be produced at a polymerization temperature in a range of from 180° C. to 230° C. A reaction is carried out while reducing the pressure in the reaction system as required and removing water or alcohol generated at the time of condensation.

When a polymerizable monomer does not dissolve or is not compatible under a reaction temperature, a solvent having a high boiling point may be added as an auxiliary dissolution solvent for dissolution. In this case, a polycondensation reaction is performed while distilling off the auxiliary dissolution solvent. When a polymerizable monomer having poor compatibility exists in a copolymerization reaction, the polymerizable monomer having poor compatibility and an acid or an alcohol to be polycondensed with the polymerizable monomer may be condensed beforehand, and then may be polycondensed with a main component.

Examples of a catalyst usable for the production of the polyester resin include alkali metal compounds, such as sodium or lithium; alkaline earth metal compounds, such as magnesium or calcium; metal compounds, such as zinc, manganese, antimony, titanium, tin, zirconium, or germanium; phosphorous acid compounds; phosphoric acid compounds; and amine compounds.

(Release Agent)

The toner according to the exemplary embodiment contains a release agent. Examples of the release agent include paraffin wax, such as low molecular weight polypropylene or low molecular weight polyethylene; a silicone resin; rosins; rice wax; carnauba wax; ester wax; and montan wax. Among the above, paraffin wax, ester wax, montan wax, and the like, are preferable, and paraffin wax, ester wax, and the like are more preferable. The melting temperature of the release agent for use in the exemplary embodiment is preferably from 60° C. (or about 60° C.) to 120° C. (or about 120° C.) and more preferably from 70° C. to 110° C. The content of the release agent in a toner is preferably from 0.5% by weight (or about 0.5% by weight) to 15% by weight (or about 15% by weight) and more preferably from 1.0% by weight to 12% by weight. When the content of the release agent is lower than 0.5% by weight, poor separation may arise particularly at the time of oil-less fixation in some cases, and gloss unevenness may be worsened in some cases. When the content of the release agent is larger than 15% by weight, image quality and image formation reliability may decrease, e.g., deterioration of the fluidity of a toner.

(Other Additives)

To the toner according to the exemplary embodiment, various ingredients, such as internal additives, a charge controlling agent, inorganic powder (inorganic particles), or organic particles, can be further added as required in addition to the above-mentioned ingredients.

Examples of the internal additives include metals such as ferrite, magnetite, reduced iron, cobalt, nickel, or manganese, alloys, or magnetic materials, such as compounds containing the metals.

Inorganic particles may be added for various purposes, and may be added for adjusting the viscoelasticity of a toner. By the viscoelasticity adjustment, image glossiness or penetration into a paper can be adjusted. As the inorganic particles, known inorganic particles, such as silica particles, titanium oxide particles, alumina particles, cerium oxide particles, or those obtained by subjecting the surface thereof to hydrophobizing treatment, can be used singly or in combination of two or more thereof. From the viewpoint of not impairing color development properties or transparency, such as OHP transparency, silica particles having a refractive index smaller than that of a binding resin are preferably used. Silica particles may be variously surface-treated, and, for example, silica particles that are surface-treated using a silane coupling agent, a titanium coupling agent, silicone oil, or the like, are preferably used.

(Properties of a Toner)

The volume average particle size of the toner according to the exemplary embodiment is preferably in the range of from 4 μm (or about 4 μm) to 9 μm (or about 9 μm), more preferably in the range of from 4.5 μm to 8.5 μm, and still more preferably in the range of from 5 μm to 8 μm. When the volume average particle size is smaller than 4 μm, the fluidity of the toner decreases and the chargeability of each particle may tend to decrease. Since a charge distribution expands, background fogging or leakage of the toner from a developing unit may be more likely to occur. When the volume average particle size is smaller than 4 μm, cleaning may become remarkably difficult in some cases. When the volume average particle size is larger than 9 μm, the resolution may decrease, and thus sufficient image quality cannot be achieved in some cases, sometimes resulting in that it becomes difficult to satisfy a recent demand for high definition.

The volume average particle size can be measured using COULTER MULTISIZER II (manufactured by Beckman Coulter) with an aperture diameter of 50 μm. In this case, the measurement is performed after the toner is dispersed in an aqueous electrolyte solution (aqueous ISOTON solution), and dispersed by an ultrasonic wave for 30 seconds or more.

The toner according to the exemplary embodiment is preferably spherical in which the shape factor SF1 is preferably in the range of from 110 (or about 110) to 140 (or about 140). When the shape is spherical in which the shape factor is in the above-mentioned range, transfer efficiency and image denseness improve, and thus a high definition image is formed.

The shape factor SF1 is more preferably in the range of from 110 to 130.

Here, the shape factor SF1 is determined by Equation (1).

$$SF1=(ML^2/A)\times(\pi/4)\times 100 \qquad \text{Equation (1)}$$

In Equation (1), ML represents the absolute maximum length of the toner and A illustrates a projection area of the toner, respectively.

The SF1 is digitized mainly by analyzing a microscopic image or a scanning electron microscopic (SEM) image using an image analyzer and can be calculated, for example, in a manner as described below. More specifically, optical microscopic images of particles scattered on the surface of a slide glass are taken into a Luzex image analyzer through a video camera to determine the maximum length and the projection area of the particles of 100 or more. Then, the SF1 is calculated according to Equation (1) and is determined as the average value thereof.

The toner according to the exemplary embodiment may be used in a toner set with at least one color toner selected from the group consisting of a cyan toner, a magenta toner, a yellow toner, and a black toner.

A colorant for use in the color toner may be a dye or a pigment, and a pigment is preferable from the viewpoint of lightfastness or water resistance.

Examples of a preferable colorant include known pigments, such as carbon black, aniline black, aniline bole, chalco oil blue, chrome yellow, ultra marine blue, Dupont oil red, quinoline yellow, methylene blue chloride, phthalocyan blue, malachite green oxalate, lamp black, rose bengal, quinacridone, benzidine yellow, C.I. pigment red 48:1, C.I. pigment red 57:1, C.I. pigment red 122, C.I. pigment red 185, C.I. pigment red 238, C.I. pigment yellow 12, C.I. pigment yellow 17, C.I. pigment yellow 180, C.I. pigment yellow 97, C.I. pigment yellow 74, C.I. pigment blue 15:1, and C.I. pigment blue 15:3.

The content of the colorant in a color toner is preferably in the range of from 1 part by weight to 30 parts by weight based on 100 parts by weight of a binding resin. A colorant that has been surface treated or a pigment dispersant may be used as required. By selecting the type of the colorant, a yellow toner, a magenta toner, a cyan toner, a black toner, or the like, can be obtained.

The color toner in the exemplary embodiment may contain the same ingredients as the toner (transparent toner) according to the exemplary embodiment, except that the color toner contains a colorant. Preferable ranges relating to the properties of the toner, such as a particle size, are the same as those of the toner according to the exemplary embodiment.

<Method for Producing a Toner>

A method for producing the toner according to the exemplary embodiment is not limited, and the toner is produced by known dry type methods, such as a kneading•pulverization method or known wet type methods, such as an emulsion aggregation method or a suspension polymerization method. Among these methods, an emulsion aggregation method allowing easy production of a toner having a core shell structure is preferable. Hereinafter, a method for producing the toner according to the exemplary embodiment by an emulsion aggregation method will be described in detail.

The emulsion aggregation method according to the exemplary embodiment includes emulsifying raw materials used in the toner to form resin particles (emulsion particles) (emulsifying step), forming an aggregate of the resin particles (aggregation step), and coalescing the aggregate (coalescence step).

(Emulsifying Step)

A resin particle dispersion liquid can be produced by, for example, applying shearing force with a disperser to a solution in which a water-based medium and a resin are mixed. In this case, particles can be formed by reducing the viscosity of a resin component by heating. For stabilization of the dispersed resin particles, a dispersant may be used. When a resin is oil based and dissolves in a solvent whose solubility in water is relatively low, a resin particle dispersion liquid can be produced by melting the resin in the solvents to be dispersed in a particle manner in water together with a dispersant or a polymer electrolyte, and then heating the resultant mixture or reducing the pressure thereof to evaporate the solvent.

Examples of the water-based medium include water, such as distilled water or ion-exchanged water; and alcohols and the water-based medium is preferably water.

Examples of a dispersant for use in the emulsifying step include water-soluble polymers, such as polyvinyl alcohol, methylcellulose, ethyl cellulose, hydroxyethylcellulose, carboxymethylcellulose, sodium polyacrylate, or sodium polymethacrylate; surfactants, such as anionic surfactants, such as sodium dodecylbenzenesulfonate, octadecylsodium sulfate, sodium oleate, sodium laurylate, or potassium stearate, cationic surfactants, such as lauryl amine acetate, stearylamine acetate, or lauryl trimethyl ammoniumchloride, amphoteric ionic surfactants, such as lauryldimethyl amine oxide, nonionic surfactants, such as polyoxyethylene alkyl ether, polyoxyethylene alkyl phenyl ether, or polyoxyethylene alkylamine; and inorganic salts, such as tricalcium phosphate, aluminum hydroxide, calcium sulfate, calcium carbonate, or barium carbonate.

Examples of a dispersing machine for use in the production of the emulsified liquid include a homogenizer, a homomixer, a pressurizing kneader, an extruder, and a media dispersing machine. As the size of the resin particles, the average particle size (volume average particle size thereof) is preferably 1.0 μm or lower, more preferably in the range of from 60 nm to 300 nm, and still more preferably in the range of from 150 nm to 250 nm. When the average particle size is lower than 60 nm, the resin particles may be stable particles in a dispersion liquid. Therefore, aggregation of the resin particles may becomes difficult in some cases. When the average particle size exceeds 1.0 μm, the aggregation properties of the resin particles may improve, whereby toner may be more easily produced. However, a particle size distribution of a toner may be enlarged in some cases.

For preparation of a release agent dispersion liquid, a release agent is dispersed in water together with an ionic surfactant or a polymer electrolyte, such as a polymeric acid or a polymeric base, and then the resultant mixture is dispersed using a homoginizer or a pressure-discharge-type dispersing machine capable of heating the mixture to a temperature equal to or higher than the melting point of the release agent and applying a strong shearing force. The release agent dispersion liquid can be obtained through the treatments. The addition of inorganic compounds, such as polyaluminum chloride, to the dispersion liquid at the time of dispersion treatment makes it possible for the release agent to contain metal elements, such as Al. Examples of an inorganic compound include polyaluminum chloride, aluminum sulfate, high basic polyaluminum chloride (BAC), polyaluminum hydroxide, and aluminum chloride. Among the above, examples of preferable examples include polyaluminum chloride and aluminum sulfate. The release agent dispersion liquid is used for an emulsion aggregation method, and also can be used for producing a toner by a suspension-polymerization method.

By the dispersion treatment, the release agent dispersion liquid contains release agent particles having a volume average particle size of 1 μm or lower may be obtained. A more preferable volume average particle size of the release agent particles is from 100 nm to 500 nm.

When the volume average particle size is lower than 100 nm, the release agent component may generally become hard to be incorporated into a toner, depending on the properties of the binding resin to be used. When the volume average particle size exceeds 500 nm, the dispersion state of the release agent in the toner becomes insufficient in some cases.

(Aggregation Step)

In the aggregation step, the resin particle dispersion liquid, the release agent dispersion liquid, etc., are mixed to be used as a mixed liquid, and the mixed liquid is heated at a temperature equal to or lower than the glass transition temperature of the resin particles for aggregation to form aggregated particles. The aggregated particles may be formed by, for example, making the pH of the mixed liquid acidic under stirring in many cases. The pH is preferably in the range of from 2 to 7, and, in this case, it is effective to use a coagulant.

In the aggregation step, the release agent dispersion liquid may be added and mixed at once together with various dispersion liquids, such as a resin particle dispersion liquid, or may be divided into several portions and added in a divided manner.

As a coagulant, a surfactant having a polarity reverse to that of the surfactant for use in the dispersant, inorganic metal salts, and di- or higher valent metal complexes can be preferably used. Particularly when metal complexes are used, the used amount of the surfactant can be reduced and chargeability improves, and thus the use thereof is preferable.

Examples of the inorganic metal salt include metal salts, such as calcium chloride, calcium nitrate, barium chloride, magnesium chloride, zinc chloride, aluminum chloride, or aluminum sulfate and inorganic metal salt polymers, such as polyaluminum chloride, polyaluminum hydroxide, or calcium polysulfide. Among the above, aluminum salt and polymers thereof are particularly preferable. In order to obtain a narrower particle size distribution, divalent inorganic metal salts are more preferable than monovalent metal salts, trivalent inorganic metal salts are more preferable than divalent inorganic metal salts, tetravalent inorganic metal salts are more preferable than trivalent inorganic metal salts, and for those having the same valency, an inorganic metal salt polymer is more preferable.

In the exemplary embodiment, it is preferable to use a polymer of tetravalent inorganic metal salt containing aluminum for obtaining a narrow particle size distribution.

By additionally adding the resin particle dispersion liquid when the particle size of the aggregated particles reach a desired particle size (coating step), a toner having a structure in which the surface of the core aggregated particles are covered with a resin may be produced. In this case, the release agent or the colorant is less likely to be exposed to the surface of a toner. Therefore, such a structure is preferable from the viewpoint of chargeability or development properties. When the resin particle dispersion liquid is additionally added, a coagulant may be added or the pH may be adjusted before the additionally adding the resin particle dispersion.

(Coalescence Step)

In the coalescence step, the progress of aggregation is stopped by increasing the pH of a suspension of aggregated particles to be in the range of from 3 to 9 under stirring conditions according to the aggregation step, and the aggregated particles are coalesced by heating at a temperature equal to or higher than the glass transition temperature of the resin. When covered with the resin, the resin is also coalesced to cover the core aggregated particles. The heating may be performed so that coalescence may be effected, and may be performed for from 0.5 hour to 10 hours.

The resultant mixture is cooled after coalescence, and coalesced particles are obtained. In the cooling step, near the glass transition temperature of the resin (in the range of ±10° C. of the glass transition temperature) the cooling rate may be reduced, i.e., the mixture is gradually cooled so that crystallization may be accelerated.

The coalesced particles obtained by coalescence can be formed into toner particles through a solid-liquid separation step, such as filtration, and, as required, a washing step and a drying step.

—External Additive and Internal Additive—

To the obtained toner particles, an inorganic oxide, representative examples of which including silica, titania, and aluminum oxide, can be added and adhered for the purpose of charge controlling, giving fluidity, giving charge exchangeability, etc. The addition and adhesion thereof can be performed by a V type blender, a HENSCHEL mixer, a LOEDIGE mixer, or the like, and the adhesion can be carried out in plural stages.

Examples of the inorganic particles includes silica, alumina, titanium oxide, barium titanate, magnesium titanate, calcium titanate, strontium titanate, zinc oxide, quartz sand, clay, mica, wollastonite, diatom earth, cerium chloride, Indian red, chrome oxide, cerium oxide, antimony trioxide, magnesium oxide, zirconium oxide, silicon carbide, and silicon nitride. Among the above, silica particles and/or titania particles are preferable, and particularly silica particles and titania particles that have been subjected to hydrophobizing treatment are preferable.

The inorganic particles are generally used in order to increase the fluidity of a toner. Among the inorganic particles mentioned above, when metatitanic acid $TiO(OH)_2$ is used, a toner that exhibits excellent transparency and favorable chargeability, environmental stability, fluidity, caking resistance, stable negative chargeability, and stable image quality maintaining properties, may be obtained. A metatitanic acid compound that has been subjected to hydrophobizing treatment may have an electric resistance of $10^{10}$ ohm·cm or more because in this case high transfer properties may be obtained without generating a toner charged in reverse polarity even when a transfer electric field is increased. As the volume average particle size of the external additive for giving fluidity, a primary particle size is preferably in the range of from 1 nm to 40 nm and more preferably in the range of from 5 nm to 20 nm. The volume average particle size of the external additive for increasing transfer properties is preferably from 50 nm to 500 nm. It is preferable for the external additive particles to be surface-modified, such as hydrophobizing, from the viewpoints of stabilizing chargeability and development properties.

As a measure for surface modification, known methods may be used. Specific examples include various coupling treatment using silane, titanate, and aluminate. Coupling agents for use in the coupling treatments are not limited, and examples include silane coupling agents, such as methyl trimetoxysilane, phenyltrimethoxysilane, methylphenyl dimethoxysilane, diphenyl dimethoxysilane, vinyltrimethoxysilane, γ-aminopropyltrimethoxysilane, γ-chloropropyltrimetoxysilane, γ-bromopropyltrimethoxysilane, γ-glycidoxypropyltrimetoxysilane, γ-mercaptopropyltrimethoxysilane, γ-ureido propyltrimethoxysilane, fluoroalkyl trimethoxysilane, or hexamethyldisilazane; titanate coupling agents; and aluminate coupling agents.

Furthermore, various additives may be added as required, and examples of the additives include other fluidizers, auxiliary cleaning agents, such as polystyrene particles, polymethylmethacrylate particles, or polyvinylidene fluoride particles, and abrasives for the purpose of removing photoreceptor deposits, such as zinc stearylamide or strontium titanate.

The addition amount of the external additives is preferably from 0.1 part by weight (or about 0.1 part by weight) to 5 parts by weight (or about 5 parts by weight) and more preferably from 0.3 part by weight to 2 parts by weight per 100 parts by weight of the toner particles. When the addition amount is lower than 0.1 part by weight, the fluidity of a toner may deteriorate in some cases, and also malfunctions, such as deterioration of chargeability or deterioration of charge exchangeability, may arise. In contrast, when the addition amount is larger than 5 parts by weight, an excessive covering state may be caused, excess inorganic oxides may move to a contact member, and secondary defect may be caused in some cases.

Furthermore, after the external addition, coarse toner particles may be removed, as required, using an ultrasonic sieving machine, a vibration sieving machine, a wind sieving machine, or the like.

In addition to the external additive mentioned above, other ingredients (particles) may be added, and examples thereof include a charge controlling agent, organic particles, a lubricant, and an abrasive.

The charge controlling agent is not limited, and those of colorless or pale color can be preferably used. Examples include quaternary ammonium salt compounds, nigrosin compounds, complexes of aluminum, iron, or chromium, and triphenyl methane pigments.

Examples of the organic particles include particles that are generally used as external additives for the surface of a toner, and examples thereof include a vinyl resin, a polyester resin, and a silicone resin. Inorganic particles or organic particles can be used as an auxiliary fluidity agent, an auxiliary cleaning agent, or the like.

Examples of the lubricant include fatty acid amides, such as ethylenebisstearylacid amide and oleic amide, and fatty acid metal salts, such as zinc stearate and calcium stearate.

Examples of the abrasive include the above-mentioned silica, alumina, and cerium oxide.

<Electrostatic Latent Image Developer>

An electrostatic latent image developer according to the exemplary embodiment at least contains the toner according to the exemplary embodiment.

The toner according to the exemplary embodiment is used, as it is, as a one-component developer. Alternatively, the toner according to the exemplary embodiment may be used in a two-component developer. When used in a two component developer, the toner is mixed with a carrier.

A carrier usable for a two component developer is not limited, and known carriers may be used. Examples include magnetic metals, such as iron oxide, nickel, and cobalt, magnetic oxides, such as ferrite and magnetite, resin coated carriers having a resin coating layer on the surface of the core materials, and magnetic dispersed carriers. Furthermore, resin-dispersed carriers in which an electro-conductive material or the like is dispersed in a matrix resin may be used.

Examples of the coating resins or matrix resins for use in the carriers include, but not limited thereto, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins containing an organosiloxane bond and modified products thereof, fluororesins, polyesters, polycarbonates, phenol resins, and epoxy resins.

Examples of the electro-conductive materials include, but not limited thereto, metals, such as gold, silver, and copper, carbon black, titanium oxide, zinc oxide, barium sulfate, aluminum borate, potassium titanate, tin oxide, and carbon black. As electro-conductive materials, white electro-conductive agents, such as zinc oxide or titanium oxide, are preferable. By the use of the white electro-conductive agent, when a carrier piece is transferred to an object, the carrier piece may be less likely to be conspicuous in a toner image.

Examples of the carrier core material include magnetic metals, such as iron, nickel, and cobalt, magnetic oxides, such as ferrite and magnetite, and glass beads. In order to use the carrier for a magnetic brush method, the carrier core material is preferably a magnetic material. The volume average particle size of the carrier core material may be generally in the range of from 10 μm to 500 μm and is preferably in the range of from 30 μm to 100 μm.

Examples of the method for coating the surface of the carrier core material with a resin include a method which involves coating the carrier core material with a coating layer-forming solution, in which the above coating resin, and, as required, various additives, are dissolved in an appropriate solvent. The solvent is not limited, and may be selected considering the coating resin to be used, ease of application, etc.

Specific examples of resin coating methods include immersion methods in which the carrier core material is immersed in a coating layer-forming solution, spray methods in which a coating layer-forming solution is sprayed onto the surface of the carrier core material, fluidized bed methods in which a coating layer-forming solution is atomized while the carrier core material is maintained in a floating state using an air flow, and kneader coater methods in which the carrier core material and a coating layer-forming solution are mixed in a kneader coater, and the solvent is then removed.

As the mixing ratio (weight ratio) between the toner according to the exemplary embodiment and the carrier in the two-component developer described above, a toner: carrier ratio is preferably from approximately 1:100 to 30:100 and more preferably from approximately 3:100 to 20:100.

<Toner Cartridge, Process Cartridge and Image Forming Apparatus>

The image forming apparatus according to the exemplary embodiment includes a latent image holding member, a developing unit that develops the latent image formed on the latent image holding member into a toner image using an electrostatic latent image developer of the exemplary embodiment, a transfer unit that transfers the toner image formed on the latent image holding member onto a receiving member, and a fixing unit that fixes the toner image transferred onto the receiving member. The image forming apparatus may further include additional unit(s), such as a cleaning unit that cleans a remaining component on the latent image holding member after the transferring, if necessary.

The image forming apparatus according to the exemplary embodiment may be, for example, a color image forming apparatus that forms a color image by sequentially repeating primarily transferring of a toner image held on the latent image holding member, such as a photoreceptor drum, to a intermediate transfer body. Alternatively, the image forming apparatus according to the exemplary embodiment may be, for example, a tandem type color image forming apparatus in which multiple latent image holding members each of which is provided with at least a developing device for one color are disposed on a intermediate transfer body in series.

In the image forming apparatus, a portion containing the developing unit may have a cartridge structure (process cartridge) that is detachable from/to an image forming apparatus body. As the process cartridge, a process cartridge according to the exemplary embodiment at least having a developer holder and containing an electrostatic latent image developer according to the exemplary embodiment is preferably used.

Hereinafter, the image forming apparatus according to the exemplary embodiment will be described with reference to the drawings.

FIG. 1 is a schematic configuration diagram illustrating an example of the image forming apparatus according to the exemplary embodiment. The image forming apparatus shown in FIG. 1 is one example of the exemplary embodiment and relates to a tandem type structure in which plural photoreceptors as a latent image holding member, i.e., plural image formation units, are provided.

In the image forming apparatus according to the exemplary embodiment, four image formation units 50Y, 50M, 50C, and 50K for forming images of respective colors of yellow, magenta, cyan, and black, respectively and an image formation unit 50T forming a transparent image are disposed at intervals in parallel (in the form of tandem) as illustrated in FIG. 1.

Here, the respective image formation units 50Y, 50M, 50C, 50K, and 50T have the same structure except the color of a toner in a developer contained in each unit, and thus the description will be given to the image formation unit SOY for forming a yellow image as a typical example. The descriptions of the image formation units 50M, 50C, 50K and SOT are omitted by giving reference numerals designating magenta (M), cyan (C), black (K), and transparent (T) instead of yellow (Y), to portions equivalent to those of the image formation unit 50Y. In the exemplary embodiment, the toner according to the exemplary embodiment is used as a toner (transparent toner) in a developer contained in the image formation unit 50T.

The yellow image formation unit 50Y has a photoreceptor 11Y as a latent image holding member. The photoreceptor 11Y is configured to rotate at a given process speed by a driving unit (not illustrated) along the direction of arrow A in FIG. 1. As the photoreceptor 11Y, an organic photoreceptor having sensitivity in an infrared region is used, for example.

A charging roll (charging unit) 18Y is provided on the upper portion of the photoreceptor 11Y. To the charging roll 18Y, a given voltate is applied by a power source (not illustrated), and the surface of the photoreceptor 11Y is charged to a given potential.

At the periphery of the photoreceptor 11Y, an exposure device (electrostatic latent image formation unit) 19Y for exposing the surface of the photoreceptor 11Y to light to form an electrostatic latent image is disposed at the downstream side of the rotation direction of the photoreceptor 11Y relative to the charging roll 18Y. Here, as the exposure device 19Y, an LED array by which reduced size may be enabled is used in view of a space. However, the exposure device 19Y is not limited thereto, and an electrostatic latent image formation unit using another laser beam may be used.

At the periphery of the photoreceptor 11Y, a developing device (developing unit) 20Y having a developer holder for holding a yellow color developer is disposed at the downstream side of the rotation direction of the photoreceptor 11Y relative to the exposure device 19Y, such that the electrostatic latent image formed on the surface of the photoreceptor 11Y is developed with a yellow color toner to form a toner image on the surface of the photoreceptor 11Y.

An intermediate transfer belt (primary transfer unit) 33 for primarily transferring the toner image formed on the surface of the photoreceptor 11Y is disposed under the photoreceptor 11Y in such a manner that the intermediate transfer belt is stretched under the five photoreceptors 11T, 11Y, 11M, 11C, and 11K. The intermediate transfer belt 33 is pressed against the surface of the photoreceptor 11Y by the primary transfer roll 17Y. The intermediate transfer belt 33 is tensioned by three rolls, i.e., a driving roll 12, a support roll 13, and a biasing roll 14, and is configured to rotate in the direction of arrow B at a moving rate equal to the process speed of the photoreceptor 11Y. On the surface of the intermediate transfer belt 33, prior to the yellow toner image primarily transferred as described above, a transparent toner image is primarily transferred, the yellow toner image is then primarily transferred, and the toner images of respective colors of magenta, cyan, and black are successively primarily transferred so that the toner images are disposed as multiple layers on the intermediate transfer belt 33.

At the periphery of the photoreceptor 11Y, a cleaning device 15Y for cleaning a toner remaining on or re-transferred to the surface of the photoreceptor 11Y is disposed at the downstream side of the rotation direction (direction of arrow A) of the photoreceptor 11Y relative to the primary transfer roll 17Y. A cleaning blade in the cleaning device 15Y is attached in such a manner that the cleaning blade is in pressure-contact with the surface of the photoreceptor 11Y in a counter direction.

To the biasing roll 14 for tensioning the intermediate transfer belt 33, a secondary transfer roll (secondary transfer unit) 34 is disposed so as to be in pressure-contact with the biasing roll 14 through the intermediate transfer belt 33. The toner images that have been primarily transferred to the surface of the intermediate transfer belt 33 and are disposed thereon is electrostatically transferred to the surface of a recording paper (transfer object) P fed from a paper cassette (not illustrated) at the pressure-contact portion of the biasing roll 14 and the secondary transfer roll 34. In this case, among the toner images that have been transferred to and disposed on the intermediate transfer belt 33, the transparent toner image is located at the bottom (position in contact with the intermediate transfer belt 33), and thus among the toner images transferred to the surface of the recording paper P, the transparent toner image is located at the top.

At the downstream side of the secondary transfer roll 34, a fixing device (fixing unit) 35 for fixing the toner images, which have been transferred as multiple layers onto the recording paper P, to the surface of the recording paper P by heat and a pressure to form a permanent image, is disposed.

Examples of the fixing device used in the exemplary embodiment include a belt-like fixation belt using a low surface energy material such as a fluororesin component or a silicone resin for the surface, and a cylindrical fixing roll using a low surface energy material such as a fluororesin component or a silicone resin for the surface.

Next, operation of each of the image formation units 50T, 50Y, 50M, 50C, and 50K for forming images of respective colors of transparent color, yellow, magenta, cyan, and black will be described. The operation of each of the image formation units 50T, 50Y, 50M, 50C, and 50K is substantially the same, and thus the operation of the yellow image formation unit 50Y will be described as a typical example.

In the yellow developing unit 50Y, the photoreceptor 11Y rotates at a given process speed in the direction of arrow A. By the charging roll 18Y, the surface of the photoreceptor 11Y is minus-charged to a given potential. Thereafter, the surface of the photoreceptor 11Y is exposed to light by the exposure device 19Y, and then an electrostatic latent image in accordance with image information is formed. Subsequently, the toner that has been minus-charged is reverse-developed by the developing device 20Y, and the electrostatic latent image formed on the surface of the photoreceptor 11Y is visuallized on the surface of the photoreceptor 11Y, whereby a toner image is formed. Thereafter, the toner image on the surface of the photoreceptor 11Y is primarily transferred to the surface of the intermediate transfer belt 33 by the primary transfer roll 17Y. After primary transferring, remaining components after transfer, such as a toner remaining on the surface of the photoreceptor 11Y, are scratched by the cleaning blade of the cleaning device 15Y, and then the surface of the photoreceptor 11Y is cleaned. Then, the photoreceptor 11Y is ready for the following image formation processes.

The above operation is performed in each of the image formation units 50T, 50Y, 50M, 50C, and 50K, and the toner image visualized on each of the photoreceptors 11T, 11Y, 11M, 11C, and 11K is successively transferred to the surface of the intermediate transfer belt 33 so that multiple toner layers are disposed on the intermediate transfer belt. When forming images in a color mode, toner images of respective colors of transparent color, yellow, magenta, cyan, and black are transferred in the stated order so that multiple toner layers are disposed on the intermediate transfer belt. When forming images in a two-color mode or a three-color mode, the order is the same as above, and only toner images of required colors are transferred so that multiple toner layers or a single toner layer are disposed on the intermediate transfer belt. Thereafter, the toner images that have been transferred to the surface of the intermediate transfer belt 33 to form a single toner layer or multiple toner layers, are secondarily transferred to the surface of the recording paper P conveyed from the paper cassette (not illustrated) by a secondary transfer roll 34, and are then heated and pressurized in the fixing device 35 to be fixed. A toner remaining on the surface of the intermediate transfer belt 33 after secondary transfer is cleaned by a belt cleaner 16 including a cleaning blade for the intermediate transfer belt 33.

In the example shown in FIG. 1, the yellow image formation unit 50Y is configured as a process cartridge including the developing device 20Y containing the developer holder for holding a yellow electrostatic latent image developer, the photoreceptor 11Y, the charging roll 18Y, and the cleaning device 15Y in one unit that is detachably mounted to the image forming apparatus main body. The image formation units 50T, 50K, 50C, and 50M are also configured as a process cartridge similarly as the image formation unit 50Y.

Next, the toner cartridge according to the exemplary embodiment will be described. The toner cartridge according to the exemplary embodiment is detachably attached to an image forming apparatus, and contains a toner to be supplied to the developing unit provided in the image forming apparatus. The toner cartridge according to the exemplary embodiment to contain at least a toner, and, therefore, the toner cartridge according to the exemplary embodiment may contain, for example, a developer, depending on the mechanism of the image forming apparatus.

By using the toner cartridge containing the toner according to the exemplary embodiment in the image forming apparatus which has a structure in which a toner cartridge is detachably mounted, the toner according to the exemplary embodiment can be easily supplied to the developing device.

The image forming apparatus illustrated in FIG. 1 is an image forming apparatus having a structure in which toner cartridges 40Y, 40M, 40C, 40K, and 40T are detachable, and the developing devices 20Y, 20M, 20C, 20K, and 20T are connected to the toner cartridges corresponding to the developing devices (color) through a toner supply pipe (not illustrated). When the toner stored in the toner cartridge decreases, the toner cartridge can be replaced.

<Image Forming Method>

An image forming method according to the exemplary embodiment of the invention includes forming an electrostatic latent image on a latent image holding member (latent image forming step); developing the latent image formed on the latent image holding member to form a toner image using the electrostatic latent image developer according to the exemplary embodiment contained in a developer holder (image forming step); transferring the toner image formed on the latent image holding member onto a receiving member (transferring step); and fixing the toner image transferred onto the receiving member (fixing step), wherein a shape factor SF1 of release agent domains in the cross-section of the fixed toner image is from 100 (or about 100) to 140 (or about 140).

When the shape factor SF1 of the release agent domains in the cross section of the transparent toner image formed with the toner according to the exemplary embodiment is from 100 to 140, irregular reflection of light that has passed through the fixed image may be suppressed because the release agent domains are spherical, and thus the development of gloss unevenness after fixation may be suppressed.

The shape factor SF1 of the release agent domains is preferably from 100 to 135 and more preferably from 100 to 130.

The shape factor SF1 of the release agent domains in the cross section of the toner image refers to a value measured as follows.

The toner image is cut into 5 mm square, and is embedded using a bisphenol A type liquid epoxy resin and a curing agent, thereby producing a cutting sample. Next, the cutting sample is cut at −100° C. using a cutting machine using a diamond knife, e.g., LEICA ULTRAMICROTOME (manufactured by Hitachi Technologies), so as to have a thickness of 100 nm, thereby producing an observation sample. At this time, in order to observe the toner image, the cutting sample is cut in a direction vertical to the toner image. Thus, the observation of the cross section of the toner image is facilitated. Next, the toner cross section is observed using a scanning electron microscope (TEM). The obtained microscope image is taken into a Luzex image analyzer through a video camera to determine the maximum length and the projection area of 100 or more release agent domains. Then, the SF1 is calculated according to Equation (1) as described above and is determined as the average value thereof.

In the toner according to the exemplary embodiment, the crystal growth of the release agent in the fixing step may be suppressed. Therefore, the crystal form of the release agent may be hard to become a flat shape, and a spherical shape may be easily maintained. As a result, the shape factor SF1 value of the release agent domains in the cross-section of the fixed toner image is from 100 to 140.

EXAMPLES

Hereinafter, the exemplary embodiment will be described in more detail with reference to Examples, but the exemplary embodiment is not limited to the following Examples. Unless otherwise specified, "part(s)" means "part(s) by weight".

Preparation of Release Agent Dispersion Liquid (1)

Paraffin wax (trade name: FT115, manufactured by Nippon Seiro Co., Ltd., melting temperature: 113° C.): 100 parts Anionic surfactant (trade name: NEOGEN RK, manufactured by Dai-Ichi Kogyo Seiyaku Co., Ltd.): 1.0 part PAC (polyaluminum chloride, manufactured by Oji Paper Co., Ltd.: 30% powder product): 0.5 part Ion-exchanged water: 400 parts The above components are mixed, and then heated to 95° C. The resultant mixture is dispersed using a homogenizer (trade name: ULTRA TURRAX T50, manufactured by IKA). Thereafter, the resultant mixture is dispersed for 360 minutes by MANTON-GAULIN high pressure homogenizer (manufactured by Gaulin Corporation), thereby preparing release agent dispersion liquid (1) (solid content concentration: 20%) in which a release agent having a volume average particle size of 0.24 μm is dispersed.

Preparation of Release Agent Dispersion Liquid (2)

Release agent dispersion liquid (2) (solid content concentration: 20%) obtained by in which a release agent having a volume average particle size of 0.23 μm is dispersed, is prepared in a manner substantially similar to the preparation of release agent dispersion liquid (1), except that PAC is not added.

Preparation of Release Agent Dispersion Liquid (3)

Release agent dispersion liquid (3) (solid content concentration: 20%) in which a release agent having a volume average particle size of 0.21 μm is dispersed, is prepared in a manner substantially similar to the preparation of release agent dispersion liquid (1), except that the amount of PAC is changed to 0.2 part.

Preparation of Release Agent Dispersion Liquid (4)

Release agent dispersion liquid (4) (solid content concentration: 20%) in which a release agent having a volume average particle size of 0.25 μm is dispersed, is prepared in a manner substantially similar to the preparation of release agent dispersion liquid (1), except that the amount of PAC is changed to 0.7 part.

Synthesis of Polyester Resins

—Preparation of polyester resin (1)—

Dimethyl adipate: 74 parts

Dimethyl terephthalate: 192 parts

Bisphenol A ethylene oxide adduct: 216 parts

Ethylene glycol: 38 parts

Tetrabutoxy titanate (catalyst): 0.037 part

The above components are placed in a two-necked flask that has been heated and dried, nitrogen gas is introduced into the container, and the temperature is increased while an inert atmosphere is maintained and the contents in the flask are being stirred. Thereafter, a co-condensation polymerization reaction is carried out at 160° C. for 7 hours. Then, the temperature is increased to 220° C. while gradually reducing the pressure to 10 Torr, and the temperature is maintained for 4 hours. Then, the pressure is once returned to normal pressure, and 9 parts of trimellitic anhydride is added. The pressure is gradually reduced to 10 Torr again, and the temperature is held at 220° C. for 1 hour, thereby synthesizing polyester resin (1).

When the molecular weight of the obtained polyester resin (1) is measured using GPC according to the measurement method described above, the weight average molecular weight (Mw) is 12,000 and the number average molecular weight is 4,000.

—Preparation of polyester resin (2)—

Bisphenol A ethylene oxide 2 mol adduct: 114 parts

Bisphenol A propylene oxide 2 mol adduct: 84 parts

Dimethyl terephthalate ester: 75 parts

Dodecenyl succinic acid: 19.5 parts

Trimellitic acid: 7.5 parts

The above components are placed in a 5 L flask having a stirrer, a nitrogen introducing tube, a temperature sensor, and a fractionating column. The temperature is increased to 190° C. over 1 hour, the inside of the reaction system is stirred, and then 3.0 parts of dibutyl tin oxide is placed therein. Furthermore, the temperature is increased from 190° C. to 240° C. over 6 hours while distilling off generated water, and then a dehydration condensation reaction is continued at 240° C. for further 2 hours, thereby synthesizing polyester resin (2).

The weight average molecular weight of the obtained polyester resin (2) is 58,000 and the number average molecular weight thereof is 5,600.

—Preparation of polyester resin (3)—

Bisphenol A ethylene oxide 2 mol adduct: 70 parts

Bisphenol A propylene oxide 2 mol adduct: 30 parts

Dimethyl terephthalate ester: 50 parts

Dodecenyl succinic acid: 40 parts

Fumaric acid: 5 parts

Trimellitic acid: 10 parts

The above components are placed in a 5 L flask having a stirrer, a nitrogen introducing tube, a temperature sensor, and a fractionating column. The temperature is increased to 190° C. over 1 hour, the inside of the reaction system is stirred, and then 2.5 parts of dibutyl tin oxide is placed therein. Furthermore, the temperature is increased to 240° C. from 190° C. over 6 hours while distilling off generated water, and then a dehydration condensation reaction is continued at 240° C. for further 2 hours, thereby synthesizing polyester. resin (3).

The weight average molecular weight of the obtained polyester resin (3) is 72,000 and the number average molecular weight thereof is 12,000.

Preparation of Polyester Resin Dispersion Liquids

—Preparation of Polyester Resin Dispersion Liquid (1)—

Polyester resin (1) (Mw: 12,000): 160 parts

Ethyl acetate: 233 parts

Aqueous sodium hydroxide solution (0.3N): 0.1 part

The above components are placed in a 1000 ml separable flask, heated at 70° C., and then stirred by a three-one motor (manufactured by Shinto Scientific Co., Ltd.), thereby preparing a resin mixed liquid. 373 parts of ion-exchanged water is gradually added while further stirring the resin mixed liquid for phase inversion emulsification, and then desolvation is performed, thereby obtaining polyester resin dispersion liquid (1) (solid content concentration: 30%). The volume average particle size of the resin particles in the dispersion liquid is 160 nm.

—Preparation of Polyester Resin Dispersion Liquid (2)—

Polyester resin dispersion liquid (2) (solid content concentration: 30%) is prepared in a mariner substantially similar to the preparation of polyester resin dispersion liquid (1), except that polyester resin (2) is used instead of polyester resin (1). The volume average particle size of the resin particles in the dispersion liquid is 160 nm.

—Preparation of Polyester Resin Dispersion Liquid (3)—

Polyester resin dispersion liquid (3) (solid content concentration: 30%) is prepared in a manner substantially similar to the preparation of polyester resin dispersion liquid (1), except that polyester resin (3) is used instead of polyester resin (1). The volume average particle size of the resin particles in the dispersion liquid is 160 nm.

Example 1

<Production of a Toner>

Ion-exchanged water: 450 parts

Polyester resin dispersion liquid (1): 80 parts

Polyester resin dispersion liquid (2): 340 parts

Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained for 30 minutes under the conditions of a temperature of 30° C. and a stirring rotation rate of 150 rpm while controlling the temperature by a mantle heater from the outside. Thereafter, 100 parts of release agent dispersion liquid (1) are placed therein, and the mixture is maintained for 5 minutes. Under this state, a 0.3 N aqueous nitric acid solution is added thereto, and the pH in an aggregation step is adjusted to 3.0.

0.4 part of polyaluminum chloride is added while dispersing using a homogenizer (trade name: ULTRA TURRAX T50, manufactured by TKA). Thereafter, the temperature is increased to and maintained at 50° C. while stirring, whereby the volume average particle size becomes 5.5 μm. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of the aggregated particles.

Thereafter, 40 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (1). The volume average particle size of the obtained toner (1) is 6.1 μm.

<Production of a Carrier>

14 parts of toluene 2 parts of styrene-methylmethacrylate copolymer (weight ratio: 80/20, weight average molecular weight: 70000)

0.6 part of MZ500 (zinc oxide, product of Titan Kogyo)

The above components are mixed, and the mixture is stirred with a stirrer for 10 minutes, thereby preparing a coating layer forming solution in which zinc oxide is dispersed. Next, the coating liquid and 100 parts of ferritic particles (volume average particle size: 38 μm) are placed in a vacuum degassing kneader, stirred at 60° C. for 30 minutes, decompressed while further warming, and then dried, thereby producing a carrier.

<Production of an Electrostatic Latent Image Developer>

The obtained carrier and the obtained toner (1) are mixed with a 2 L V blender at a carrier:toner ratio of 100 parts:8 parts, thereby producing an electrostatic latent image developer (1).

<Evaluation>

—Image Strength against Scratching (Scratch Resistance)—

The developer is charged in a developing device of a quintuple tandem modified model of DOCUCENTRE-IIIC7600 manufactured by Fuji Xerox Co., Ltd. (quintuple tandem modified machine for double-side printing) as illustrated in FIG. 1. A solid image (18 cm×27 cm) having a toner adhesion amount of 4.5 g/cm$^2$ is formed on both sides of an A4 recording paper (trade name: OK TOP COAT+Paper, manufactured by Oji Paper Co., Ltd.) at a fixing temperature of 190° C. Using the obtained solid image, an image scratch test (using a surface testing machine, HEIDON Type: 14DR (trade name), under the conditions of a vertical load of 300 g and a needle moving speed of 1500 mm) is performed. Then, image defects are sensory-evaluated, and judged. The obtained results are shown in Table 1. The evaluation criteria are as follows.

A: Excellent (no defects).

B: Excellent (almost no defects).

C: Practically non-problematic, but image defects are observed.

D: Image defects are largely observed. Untolerable level for practical use.

—OHP transparency—

The developer is charged in a developing device of a quintuple tandem modified model of DOCUCENTRE-IIIC7600 manufactured by Fuji Xerox Co., Ltd. (quintuple tandem modified machine for double-side printing) as illustrated in FIG. 1. A solid image (4 cm×4 cm) having a toner adhesion amount of 4.5 g/cm$^2$ is formed on an OHP at a fixing temperature of 190° C. With respect to the solid image, a ratio of scattered light to the total transmitted light is measured based on JIS K7105:81 "Test methods for optical characteristics of plastics", the disclosure of which is incorporated by reference herein, using a full automatic haze meter (trade name: TC-HIII DP type, manufactured by Tokyo Denshoku Co., Ltd.). In this example, a haze of lower than 15% is evaluated as A, a haze in the range of 15% or more and lower than 20% is evaluated as B, a haze in the range of 20% or more and lower than 30% is evaluated as C, and a haze of 30% or more is evaluated as D. The obtained results are illustrated in Table 1.

—Gloss Unevenness—

Figure 2:
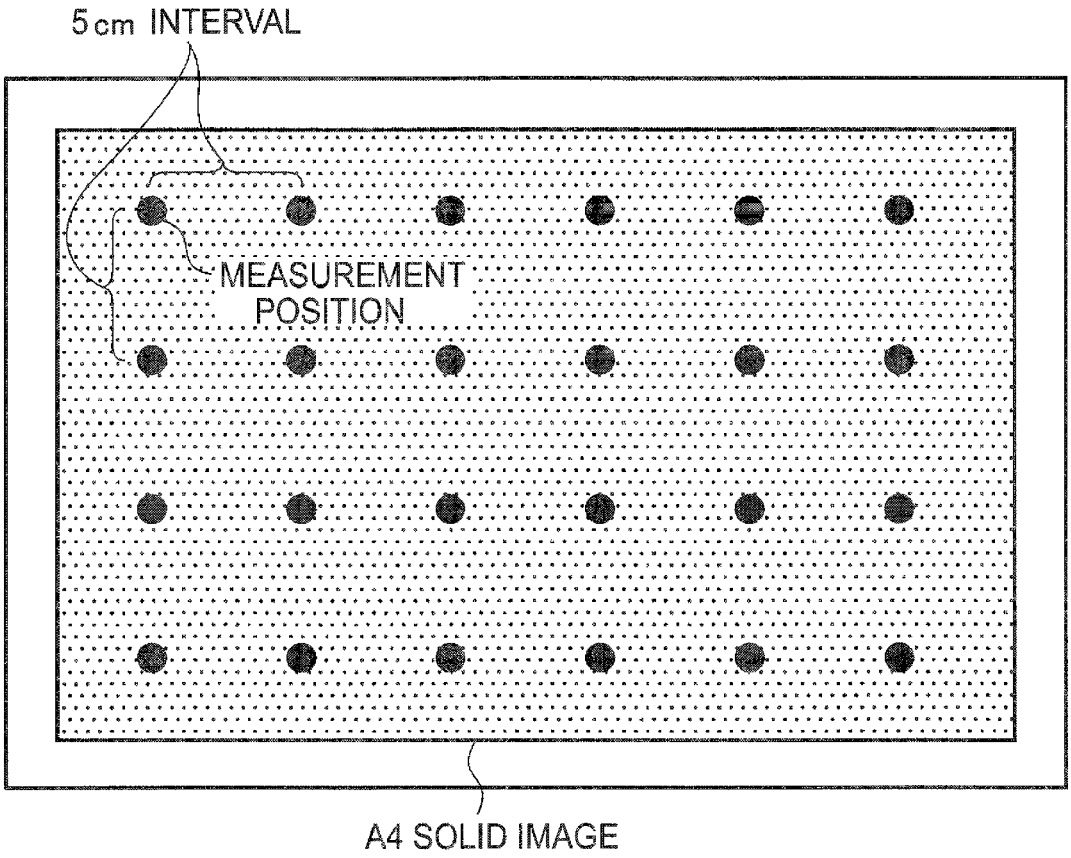
FIG. 2 illustrates a glossiness measurement position in Examples.

The obtained developer is charged in a developing device of a quintuple tandem modified model of DOCUCENTRE-IIIC7600 manufactured by Fuji Xerox Co., Ltd. (quintuple tandem modified machine for double-side printing) as illustrated in FIG. 1. A solid image (18 cm×27 cm) having a toner adhesion amount of 4.5 g/cm$^2$ is formed on both sides of an A4 recording paper (trade name: OK TOP COAT+Paper, manufactured by Oji Paper Co., Ltd.) at a fixing temperature of 190° C. With respect to an image area of the formed solid image, a preceding surface of the solid image is measured for 60° gloss at 24 points (points arranged in a lattice form at a 5 cm×5 cm interval) as illustrated in FIG. 2, using a gloss meter (BYK, Microtrigross glossimeter (trade name) (20+60+85°), manufactured by Gardner). Gloss unevenness is evaluated from a difference (maximum value−minimum value) of the glossiness at the 24 points. The evaluation criteria are as follows and the results are illustrated in Table 1.

—Evaluation Criteria of Gloss Unevenness—

A: Glossiness difference of lower than 5% and Standard deviation of gloss measurement at 24 points of 2.5 or lower
B: Glossiness difference of lower than 5%
C: Glossiness difference of 5% or more and lower than 10%
D: Glossiness difference of 10% or more When toner (1) is measured using a differential scanning calorimetry (DSC) according to the measurement method described above, the difference between Tm and Tc is 42° C. The weight average molecular weight (Mw) of toner (1) measured by GPC is 51000. Furthermore, when evaluation is performed using the electrostatic latent image developer (1), the scratch resistance is evaluated as A, the OHP transparency is evaluated as A, the gloss unevenness is evaluated as A. The results of each of the Examples and Comparative Examples are illustrated in Table 1.

Example 2

Ion-exchanged water: 450 parts
Polyester resin dispersion liquid (1): 210 parts
Polyester resin dispersion liquid (2): 210 parts
Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained for 30 minutes under the conditions of a temperature of 30° C. and a stirring rotation rate of 150 rpm while controlling the temperature by a mantle heater from the outside. Thereafter, 100 parts of release agent dispersion liquid (1) are placed therein, and the mixture is maintained for 5 minutes. Under this state, a 0.3 N aqueous nitric acid solution is added, and the pH in an aggregation step is adjusted to 3.0.

0.4 part of polyaluminum chloride is added while dispersing using a homogenizer (trade name: ULTRA TURRAX T50, manufactured by IKA), and the temperature is increased to and maintained at 50° C. while stirring, whereby the volume average particle size becomes 5.5 p.m. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of the aggregated particles.

Thereafter, 20 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at a temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (2). The volume average particle size of the obtained toner (2) is 6.0 μm.

When toner (2) is measured using a differential scanning calorimetry (DSC) according to the measurement method described above, the difference between Tm and Tc is 41° C. The weight average molecular weight (Mw) of toner (2) measured by GPC is 37000. Evaluation is performed using the obtained toner (2) and the obtained electrostatic latent image developer (2) in a manner similar to Example 1. The obtained results are illustrated in Table 1.

Example 3

Ion-exchanged water: 450 parts
Polyester resin dispersion liquid (2): 420 parts
Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained for 30 minutes under the conditions of a temperature of 30° C. and a stirring rotation rate of 150 rpm while controlling the temperature by a mantle heater from the outside. Thereafter, 100 parts of release agent dispersion liquid (1) are placed therein, and the mixture is maintained for 5 minutes. Under this state, a 0.3 N aqueous nitric acid solution is added, and the pH in an aggregation step is adjusted to 3.0.

0.4 part of polyaluminum chloride is added while dispersing using a homogenizer (trade name: ULTRA TURRAX T50, manufactured by IKA). Thereafter, the temperature is increased to and maintained at 50° C. while stirring, whereby the volume average particle size becomes 5.5 μm. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of the aggregated particles.

Thereafter, 16 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at a temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (3). The volume average particle size of the obtained toner (3) is 6.0 μm.

When toner (3) is measured using a differential scanning calorimetry (DSC) according to the measurement method described above, the difference between Tm and Tc is 43° C. The weight average molecular weight (Mw) of toner (3) measured by GPC is 68000. Evaluation is performed using the obtained toner (3) and the obtained electrostatic latent image developer (3) in a manner similar to Example 1. The obtained results are illustrated in Table 1.

Comparative Example 1

Ion-exchanged water: 450 parts
Polyester resin dispersion liquid (1): 80 parts
Polyester resin dispersion liquid (2): 340 parts
Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained for 30 minutes under the conditions of a temperature of 30° C. and a stirring rotation rate of 150 rpm while controlling the temperature by a mantle heater from the outside. Thereafter, 100 parts of release agent dispersion liquid (2) are placed therein, and the mixture is maintained for 5 minutes. Under this state, a 0.3 N aqueous nitric acid solution is added, and the pH in an aggregation step is adjusted to 3.0.

0.4 part of polyaluminum chloride is added while dispersing using a homogenizer (trade name: ULTRA TURRAX T50, manufactured by IKA). Thereafter, the temperature is increased to and maintained at 50° C. while stirring, whereby the volume average particle size becomes 5.5 μm. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of the aggregated particles.

Thereafter, 40 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at a temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (4). The volume average particle size of the obtained toner (4) is 6.3 μm.

When toner (4) is measured using a differential scanning calorimetry (DSC) according to the measurement method described above, the difference between Tm and Tc is 5° C. The weight average molecular weight (Mw) of toner (4) measured by GPC is 52000. Evaluation is performed using the obtained toner (4) and the obtained electrostatic latent image developer (4) in a manner similar to Example 1. The obtained results are illustrated in Table 1.

Comparative Example 2

Ion-exchanged water: 450 parts
Polyester resin dispersion liquid (1): 300 parts
Polyester resin dispersion liquid (2): 120 parts
Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained for 30 minutes under the conditions of a temperature of 30° C. and a stirring rotation rate of 150 rpm while controlling the temperature by a mantle heater from the outside. Thereafter, 100 parts of release agent dispersion liquid (1) are placed therein, and the mixture is maintained for 5 minutes. Under this state, a 0.3 N aqueous nitric acid solution is added, and the pH in an aggregation step is adjusted to 3.0.

0.4 part of polyaluminum chloride is added while dispersing using a homogenizer (trade name: ULTRA TURRAX T50, manufactured by IKA). Thereafter, the temperature is increased to and maintained at 50° C. while stirring, whereby the volume average particle size becomes 5.5 μm. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of the aggregated particles.

Thereafter, 40 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at a temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (5). The volume average particle size of the obtained toner (5) is 6.0 μm.

When toner (5) is measured using a differential scanning calorimetry (DSC) according to the measurement method described above, the difference between Tm and Tc is 43° C. The weight average molecular weight (Mw) of toner (5) measured by GPC is 26000. Evaluation is performed using the obtained toner (5) and the obtained electrostatic latent image developer (5) in a manner similar to Example 1. The obtained results are illustrated in Table 1.

Comparative Example 3

Ion-exchanged water: 450 parts
Polyester resin dispersion liquid (3): 420 parts
Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained for 30 minutes under the conditions of a temperature of 30° C. and a stirring rotation rate of 150 rpm while controlling the temperature by a mantle heater from the outside. Thereafter, 100 parts of release agent dispersion liquid (1) are placed therein, and the mixture is maintained for 5 minutes. Under this state, a 0.3 N aqueous nitric acid solution is added, and the pH in an aggregation step is adjusted to 3.0.

0.4 part of polyaluminum chloride is added while dispersing using a homogenizer (trade name: ULTRA TURRAX T50, manufactured by IKA). Thereafter, the temperature is increased to and maintained at 50° C. while stirring, whereby the volume average particle size becomes 5.5 μm. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of aggregated particles.

Thereafter, 40 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at a temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (6). The volume average particle size of the obtained toner (6) is 6.5 μm.

When toner (6) is measured using a differential scanning calorimetry (DSC) according to the measurement method described above, the difference between Tm and Tc is 41° C. The weight average molecular weight (Mw) of toner (6) measured by GPC is 75000. Evaluation is performed using the obtained toner (6) and the obtained electrostatic latent image developer (6) in a manner similar to Example 1. The obtained results are illustrated in Table 1.

Comparative Example 4

Ion-exchanged water: 450 parts
Polyester resin dispersion liquid (1): 80 parts
Polyester resin dispersion liquid (2): 340 parts
Anionic surfactant: 2.8 parts (trade name: NEOGEN RK, manufactured by Dai-Ichi Kogyo Seiyaku Co., Ltd., 20% by weight)

The above components are placed in a reactor equipped with a thermometer, a pH meter, and a stirrer, and maintained at a temperature of 30° C. at a stirring rotation rate of 150 rpm for 30 minutes while controlling the temperature by a mantle heater from the outside. Thereafter, 100 parts of release agent dispersion liquid (3) are placed therein, and the mixture is maintained for 5 minutes. Under this state, a 0.3 N aqueous nitric acid solution is added, and the pH in an aggregation step is adjusted to 3.0.

0.4 part of polyaluminum chloride is added while dispersing using a homogenizer (trade name: ULTRA TURRAX T50, manufactured by IKA). Thereafter, the temperature is increased to and maintained at 50° C. while stirring, whereby the volume average particle size becomes 5.5 μm. The particle size is measured by COULTER MULTISIZER II (trade name, manufactured by Beckman Coulter, an aperture diameter of 50 μm). Thereafter, 40 parts of polyester resin dispersion liquid (1) and 140 parts of polyester resin dispersion liquid (2) are additionally added, and resin particles are adhered to the surface of the aggregated particles.

Thereafter, 40 parts of 10% by weight NTA (nitrilotriacetic acid) metal salt solution (trade name: CHELEST 70, manufactured by Chelest Corporation) are added, and then the pH is adjusted to 9.0 using a 1 N aqueous sodium hydroxide solution. Thereafter, the temperature is increased to 90° C. at a temperature increase rate of 0.05° C./minute, and the temperature is maintained at 90° C. for 3 hours. Then, the resultant liquid is cooled, and filtered, thereby obtaining coarse toner particles. The coarse toner particles are further re-dispersed with ion-exchanged water, and the resultant liquid is filtered. This procedure (re-dispersion and filtration) is repeatedly performed to wash the toner particles until the electrical conductivity of the filtrate reaches 20 μS/cm or lower. Then, the resultant product is vacuum-dried in a 40° C. oven for 5 hours, thereby obtaining toner particles.

To 100 parts of the obtained toner particles, 1.5 parts of hydrophobic silica (trade name: RY50, manufactured by Japan Aerosil Co. Ltd.) and 1.0 part of hydrophobic titanium oxide (trade name: T805, manufactured by Japan Aerosil Co. Ltd.) are mixed and blended using a sample mill at 10000 rpm for 30 seconds. Thereafter, the resultant mixture is sieved using a vibration sieve with openings of 45 μm, thereby preparing toner (7). The volume average particle size of the obtained toner (7) is 6.1 μm.

When toner (7) is measured using a differential scanning calorimetry (DSC) according to the measurement method described above, the difference between Tm and Tc is 27° C. The weight average molecular weight (Mw) of toner (7) measured by GPC is 50000. Evaluation is performed using the obtained toner (7) and the obtained electrostatic latent image developer (7) in a manner similar to Example 1. The obtained results are illustrated in Table 1, Example 4

A toner (8) is produced in a manner substantially similar to the production of the toner of Example 1, except that release agent dispersion liquid (1) is changed to release agent dispersion liquid (4) in the production of the toner of Example 1. The volume average particle size of the obtained toner (8) is 6.1 μm.

When toner (8) is measured using a differential scanning calorimetry (DSC) according to the measurement method described above, the difference between Tm and Tc is 48° C. The weight average molecular weight (Mw) of toner (8) measured by GPC is 51000. Evaluation is performed using the obtained toner (8) and the obtained electrostatic latent image developer (8) in a manner similar to Example 1. The obtained results are illustrated in Table 1.

Example 5

A toner (9) is produced in a manner substantially similar to the production of the toner of Example 1, except that release agent dispersion liquid (1) is changed to release agent dispersion liquid (3) in the production of the toner of Example 1. The volume average particle size of the obtained toner (9) is 6.1 μm.

When toner (9) is measured using a differential scanning calorimetry (DSC) according to the measurement method described above, the difference between Tm and Tc is 32° C. The weight average molecular weight (Mw) of toner (9) measured by GPC is 51000. Evaluation is performed using the obtained toner (9) and the obtained electrostatic latent image developer (9) in a manner similar to Example 1. The obtained results are illustrated in Table 1.

TABLE 1

| | Difference between Tm and Tc | Mw of toner | Scratch resistance | OHP trans-parency | Gloss unevenness |
|---|---|---|---|---|---|
| Ex. 1 | 42 | 51000 | A | A | A |
| Ex. 2 | 41 | 37000 | C | A | B |
| Ex. 3 | 43 | 68000 | A | C | B |
| Comp. Ex. 1 | 5 | 52000 | B | B | D |
| Comp. Ex. 2 | 43 | 26000 | D | B | B |
| Comp. Ex. 3 | 41 | 75000 | B | D | B |
| Comp. Ex. 4 | 27 | 50000 | D | C | B |
| Ex. 4 | 48 | 51000 | A | A | A |
| Ex. 5 | 32 | 51000 | A | B | B |

The forgoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transparent toner for electrostatic latent image developing, comprising a binder resin and a release agent, the difference between Tm and Tc being from about 30° C. to about 50° C., wherein Tm is an endothermic peak temperature of the release agent determined in a temperature rising process and Tc is an exothermic peak temperature of the release agent determined in a temperature decreasing process, in a measurement by a differential scanning calorimeter (DSC) according an ASTM method, the toner having a weight average molecular weight of from about 35,000 to about 70,000, and Al being contained in a release agent domain of the toner.

2. The transparent toner for electrostatic latent image developing according to claim 1, wherein the content of Al contained in the release agent domain is from about 0.005 atomic % to about 0.1 atomic %.

3. The transparent toner for electrostatic latent image developing according to claim 1, wherein the content of the colorant in the toner is 0.01% by weight or less relative to the toner.

4. The transparent toner for electrostatic latent image developing according to claim 1, wherein the binder resin is a polyester resin.

5. The transparent toner for electrostatic latent image developing according to claim 4, wherein the polyester resin has a glass transition temperature (Tg) of from about 50° C. to about 80° C.

6. The transparent toner for electrostatic latent image developing according to claim 1, wherein the release agent has a melting temperature of from about 60° C. to about 120° C.

7. The transparent toner for electrostatic latent image developing according to claim 1, wherein the content of the release agent in the toner is from about 0.5% by weight to about 15% by weight relative to the toner.

8. The transparent toner for electrostatic latent image developing according to claim 1, wherein the toner has a volume average particle size of from about 4μm to about 9 μm.

9. The transparent toner for electrostatic latent image developing according to claim 1, wherein the toner has a shape factor SF1 of from about 110 to about 140.

10. The transparent toner for electrostatic latent image developing according to claim 1, further comprising an external additive in an amount of from about 0.1 parts by weight to about 5 parts by weight per 100 parts by weight of toner particles.

11. An electrostatic latent image developer, comprising the transparent toner for electrostatic charge developing according to claim 1.

12. The electrostatic latent image developer according to claim 11, further comprising a carrier containing a white electro-conductive agent.

13. The electrostatic latent image developer according to claim 12, wherein the white electro-conductive agent is zinc oxide or titanium oxide.

14. A toner cartridge configured to detachably attach to an image forming apparatus and containing a toner that is supplied to a developing unit in the image forming apparatus, wherein the toner is the transparent toner for electrostatic latent image developing according to claim 1.

15. A process cartridge comprising a developer holder that contains the electrostatic latent image developer according to claim 11.

16. An image forming apparatus comprising:

a latent image holding member;

a developing unit that contains the electrostatic latent image developer according to claim 11 and develops a latent image formed on the latent image holding member into a toner image using the electrostatic latent image developer;

a transfer unit that transfers the toner image formed on the latent image holding member onto a receiving member; and a fixing unit that fixes the toner image that is transferred onto the receiving member.

17. An image forming method comprising:

forming an electrostatic latent image on a latent image holding member;

developing the latent image formed on the latent image holding member to form a toner image using the electrostatic latent image developer according to claim 11 contained in a developer holder;

transferring the toner image formed on the latent image holding member onto a receiving member; and fixing the toner image transferred onto the receiving member, wherein a shape factor SF1 of a release agent domain in the cross-section of the fixed toner image is from about 100 to about 140.

* * * * *